US010087583B2

(12) United States Patent
Snelling et al.

(10) Patent No.: US 10,087,583 B2
(45) Date of Patent: Oct. 2, 2018

(54) SECURITY ELEMENTS

(75) Inventors: James Peter Snelling, Hampshire (GB); Timothy Edward Berridge, London (GB)

(73) Assignee: De La Rue International Limited, Hampshire (GB)

( * ) Notice: Subject to any disclaimer, the term of this patent is extended or adjusted under 35 U.S.C. 154(b) by 582 days.

(21) Appl. No.: 12/738,198

(22) PCT Filed: Oct. 15, 2008

(86) PCT No.: PCT/GB2008/003505

§ 371 (c)(1),
(2), (4) Date: Apr. 26, 2010

(87) PCT Pub. No.: WO2009/053673

PCT Pub. Date: Apr. 30, 2009

(65) Prior Publication Data

US 2010/0213698 A1 Aug. 26, 2010

(30) Foreign Application Priority Data

Oct. 23, 2007 (GB) ..... 0720735.0

(51) Int. Cl.
*D21H 21/40* (2006.01)
*B42D 25/364* (2014.01)
(Continued)

(52) U.S. Cl.
CPC ..... *D21H 21/40* (2013.01); *B42D 25/324* (2014.10); *B42D 25/355* (2014.10);
(Continued)

(58) Field of Classification Search
CPC ..... B42D 15/00; B42D 15/10; B42D 25/324; B42D 25/364; B42D 25/373;
(Continued)

(56) References Cited

U.S. PATENT DOCUMENTS 580,875 A 4/1897 Littlejohns
5,182,663 A * 1/1993 Jones ..... G02F 1/133553 349/113
(Continued)

FOREIGN PATENT DOCUMENTS

DE 4343387 A1 6/1995
DE 4344553 A1 6/1995
(Continued)

OTHER PUBLICATIONS

European Patent Office, "Notification of Transmittal of Intel Search Report and Written Opinion," European Patent Office, (dated Jan. 30, 2009).
(Continued)

*Primary Examiner* — Justin V Lewis
(74) *Attorney, Agent, or Firm* — Gable Gotwals

(57) ABSTRACT

The invention relates to improvements in security elements for use in or on security substrates. In particular the invention is concerned with security elements having public recognition features. The security element includes at least one light transmitting carrier substrate, a first metal layer having substantially metal-free areas defining indicia which are visible in transmitted light, a partial first light scattering layer providing further indicia which are visible in reflected light. The first light scattering layer overlaps the metal free areas in the first metal layer.

30 Claims, 4 Drawing Sheets

(51) Int. Cl.
*B42D 25/373* (2014.01)
*B42D 25/324* (2014.01)
*B42D 25/369* (2014.01)
*B42D 25/355* (2014.01)

(52) U.S. Cl.
CPC ..... *B42D 25/364* (2014.10); *B42D 25/369* (2014.10); *B42D 25/373* (2014.10)

(58) Field of Classification Search
CPC ..... B42D 25/369; B42D 25/355; G09C 3/00; C09D 11/00; D21H 21/40
USPC ..... 283/57, 58, 67, 70, 72, 74, 82, 83, 85, 283/91, 94, 98, 105, 109; 106/31.14, 106/31.32, 31.64, 31.92
See application file for complete search history.

(56) References Cited

U.S. PATENT DOCUMENTS

| | | | | |
|---|---|---|---|---|
| 5,354,099 | A * | 10/1994 | Kaule | B42D 25/355 283/82 |
| 5,639,126 | A * | 6/1997 | Dames | G07D 7/026 283/72 |
| 6,474,695 | B1 | 11/2002 | Schneider et al. | |
| 6,623,042 | B1 | 9/2003 | Jurgen | |
| 2002/0014967 | A1 | 2/2002 | Crane et al. | |
| 2006/0035066 | A1 | 2/2006 | Souparis et al. | |
| 2006/0256411 | A1 | 11/2006 | Denjean et al. | |
| 2007/0165182 | A1 | 7/2007 | Hoffmuller et al. | |
| 2007/0246933 | A1* | 10/2007 | Heim | G07D 7/2066 283/98 |
| 2008/0314284 | A1* | 12/2008 | Li | C09C 1/0015 106/31.9 |

FOREIGN PATENT DOCUMENTS

| | | | |
|---|---|---|---|
| DE | 29622700 | U1 | 6/1997 |
| DE | 19731968 | A1 | 1/1999 |
| DE | 10226114 | A1 | 7/2003 |
| DE | 10255639 | A1 | 6/2004 |
| DE | 102004031043 | A1 | 1/2006 |
| DE | 102007040865 | A1 | 11/2008 |
| EP | 0319157 | | 6/1989 |
| EP | 0330733 | A1 | 9/1989 |
| EP | 0659587 | A1 | 6/1995 |
| EP | 0773872 | | 10/1998 |
| EP | 1431063 | | 6/2004 |
| EP | 1467873 | A1 | 10/2004 |
| EP | 1547807 | A2 | 6/2005 |
| GB | 2338680 | A | 12/1999 |
| WO | 9210608 | A1 | 6/1992 |
| WO | WO 92/11142 | | 7/1992 |
| WO | 9904983 | A1 | 2/1999 |
| WO | 0153113 | A1 | 7/2001 |
| WO | 0200446 | A1 | 1/2002 |
| WO | 02051646 | A1 | 7/2002 |
| WO | 03061980 | A1 | 7/2003 |
| WO | 03095227 | A1 | 11/2003 |
| WO | WO 03/091953 | | 11/2003 |
| WO | 2004007210 | A1 | 1/2004 |
| WO | 2004020218 | A1 | 3/2004 |
| WO | 2004111338 | A1 | 12/2004 |
| WO | 2005105475 | A1 | 11/2005 |
| WO | 2006018171 | A2 | 2/2006 |
| WO | 2006066825 | A3 | 6/2006 |
| WO | 2006108607 | A2 | 10/2006 |
| WO | 2006108611 | A2 | 10/2006 |
| WO | 2006111358 | A2 | 10/2006 |
| WO | 2007006545 | A1 | 1/2007 |
| WO | 2007138255 | A1 | 12/2007 |
| WO | 2008098739 | A2 | 8/2008 |

OTHER PUBLICATIONS

Wikipedia, "Light Scattering; last updated Oct. 14, 2017", , Publisher: Wikipedia.

* cited by examiner

SECURITY ELEMENTS

CROSS-REFERENCE TO PENDING APPLICATIONS

This application is based on PCT Patent Application No. GB2008/003505, filed on Oct. 15, 2008, which was based on United Kingdom Patent Application No. 0720735.0, filed Oct. 23, 2007.

The invention relates to improvements in security elements for use in or on security substrates. In particular the invention is concerned with security elements having public recognition features.

It is widely known to use in banknotes, passports, certificates and other security documents security elements, such as security threads or strips. These security elements are partially or wholly embedded in a paper or plastic substrate, and generally provide different viewing conditions depending on whether the security document is viewed in transmitted or reflected light.

EP-A-319157, for example, describes a security element made from a transparent plastic film provided with a continuous reflective metal layer, such as aluminum, which has been vacuumed deposited on the film. The metal layer is partially demetallised to provide clear demetallised regions that form indicia. When wholly embedded within a paper substrate the security element is barely visible in reflected light. However, when viewed in transmitted light the indicia can be clearly seen highlighted against the dark background of the metallised area of the security element and adjacent areas of the paper. Such elements can also be used in a security document provided with repeating windows in at least one surface of the paper substrate in which the security element is exposed. A security document of this type, when viewed in transmitted light, will be seen as a dark line with the indicia highlighted. When viewed in reflected light on the windowed side, the bright shiny aluminum portions are readily visible in the windows. This security element has been highly successful within the market place and is supplied under the trade mark Cleartext®.

For a number of years banknote issuing authorities have had an interest in combining both the public recognition properties of Cleartext® with the covert properties of a machine-readable feature. To this end it is preferable to utilise machine-readable features that can be read using detectors already available to the banknote issuing authorities. Examples of such machine-readable devices are described in WO-A-92/11142 and EP-A-773872.

The security device of WO-A-92/11142 is an attempt to provide this combination. A security device conforming to this specification has been used commercially with some success. A central region of the security device has a metallic appearance with clear regions forming characters; on either side of this central strip in the width direction, there are layers of magnetic material with obscuring coatings to provide the necessary magnetic component. This is, however, a generally unsatisfactory means of achieving the combination of the appearance of Cleartext® with the required magnetic properties. The magnetic properties are satisfactory, but the requirement to place the magnetic layers on either side of a central region means that the latter must be relatively narrow with respect to the overall width of the security element and results in characters which are small, typically 0.7 mm high, and therefore not easily legible. Additionally, the structures of the devices described in WO-A-92/11142 are very complex and present substantial lateral registration problems in depositing the various layers;

a mis-registration of even 0.25 mm or so can allow the presence of the dark magnetic oxide to be apparent to the naked eye, thus revealing its presence and seriously detracting from the aesthetic appearance of the security element.

A more satisfactory solution, from the processibility, ease of character recognition and aesthetics points of view, would be to manufacture a device of the kind described in EP-A-0319157 from a metal which is itself magnetic. Thus the size of the characters, and ratio of character height:width of the Cleartext® product can be maximised to the benefit of visibility of the Cleartext® feature, whilst providing direct compatibility with existing magnetic detectors.

One means of achieving this is disclosed in Research Disclosure No. 323 of March 1991. In this Research Disclosure, a magnetic material-is deposited onto a flexible substrate by vacuum sputtering or other known techniques; the non-metallised regions are created by selective printing of a resist layer and subsequent chemical etching. The disclosed magnetic materials may be nickel, cobalt, iron or alloys thereof with a preferred combination of cobalt:nickel in the ratio 85:15%. The disadvantage of this method is that vacuum deposition of cobalt:nickel to the necessary thickness is a relatively slow process and somewhat wasteful of cobalt, an expensive material. Furthermore, subsequent to this vacuum deposition process, further significant processing is required to etch the characters. The resultant product is therefore relatively expensive.

A further alternative approach is described in EP A-773872 wherein a magnetic metal is deposited on a film of polymeric substrate as the substrate passes through a solution containing the magnetic metal. A preparatory priming seed print operation ensures that magnetic metal is deposited on the substrate in a chosen pattern such that when the security product is produced, the magnetic metal on the security element has a specific pattern and provides both a visual discernible security feature and a magnetically detectable security feature. This method produces a security element with satisfactory visual and machine readable characteristics. However, the manufacture is not straight forward and is costly.

One further approach is detailed in WO-A-9928852. Here the security device includes a carrier substrate, a metallic layer disposed on the carrier substrate, and a magnetic layer disposed on the metallic layer in substantial registration with at least a portion of the metallic layer, thereby providing both metallic security features and magnetic security features. The metallic layer and the magnetic layer also form graphic or visually identifiable indicia on the carrier substrate to provide a visual security feature. According to one method, the metallic layer is applied to the carrier substrate, the magnetic layer is applied to the metallic layer, and the layers are etched to form the graphic indicia. The magnetic layer can, in one embodiment, include a magnetic chemical resist that is printed on the metallic layer in the form of the graphic indicia. This method again produces a security element with acceptable visual and magnetic characteristics but again has a high cost with regard to processing and production. It also has colour implications for the security element, and elements in paper that may not always be satisfactory.

Yet further alternative solutions are described in WO-A-03091952 and WO-A-03091953. Here a security element, comprising a transparent polymer carrier layer bearing indicia formed from a plurality of opaque and non-opaque regions, is coated with a clear transparent magnetic layer containing a distribution of particles of a magnetic material of a size, and distributed in a concentration, at which the magnetic layer remains clear and transparent. However one problem has been identified with security elements conforming to WO-A-03091952 and WO-A-03091953. It has been found that, when the security element is embedded in paper, the back side of the security element appears as a dark line. This is in contrast to other prior art security elements which are hardly visible in reflected light when embedded. It is thought that this dark appearance results from the magnetic materials causing diffusion of light to a much greater extent, this diffusion of light giving rise to the dark appearance. Whereas this is of limited concern for security elements having a width of less than 1.6 mm, it becomes of greater concern for wider security elements having a width of 2 mm or more.

It is therefore desirable to produce a security element having the magnetic and transmissive properties of those described within WO-A-03091953 and WO-A-03091952 but which do not result in the obtrusive dark line appearance when embedded in paper. It has now been recognized that the dark appearance can in fact provide a highly advantageous security benefit. Research activity subsequent to this discovery has led to the development of new class of security element having an additional reflective viewing condition previously not achievable. It has been found that by selecting materials having certain properties it is possible to produce magnetic or non-magnetic security elements with the inventive features set out within the claims.

The invention therefore provides security elements suitable for embedding wholly or partially in substrates, the security elements having at least two sets of information viewable in reflection from opposite sides of the substrate.

The invention therefore comprises a security element comprising at least one light transmitting carrier substrate, a first metal layer having substantially metal-free areas defining indicia which are visible in transmitted light, a partial first light scattering layer providing further indicia which are visible in reflected light, wherein the first light scattering layer overlaps the substantially metal-free areas in the first metal layer.

The invention will now be described, by way of example only, with reference to the accompanying drawings in which:—

FIG. 1 is a plan view of a partially metallised Cleartext® security element in accordance with the prior art;

FIG. 2*a* is a plan view of a security element according to the present invention;

FIG. 2*b* is a cross sectional side elevation of the security element of FIG. 2*a* embedded in a paper substrate;

Figure 1:
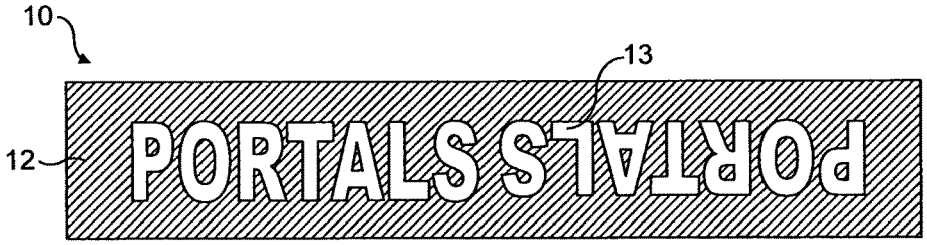

FIG. 1 shows an example of a prior art Cleartext® security element 10. The security element 10 comprises a water impermeable light transmitting plastic carrier substrate 11 on to which is deposited a thin opaque aluminum metal layer 12. The metal layer 12 is then partially removed by a demetallisation process such as, for example, direct etch, and resist and etch, to leave metal free, or substantially metal free, areas 13. Such security elements 10 having negative indicia are described in detail in EP-A-319157 and suitable demetallisation techniques described in EP-A-330733 and U.S. Pat. No. 4,652,015. It has also been suggested that the metallic negative indicia may be provided using conductive or non-conductive metal-effect inks. Whilst this is possible, it is not considered to be particularly secure or desirable though. For the purposes of the present invention, the use of vacuum metallised, and demetallised, layer is preferred, although the use of printed metal effect layers is also recognized as possible. Whilst it is preferred that the areas 13 are metal free, it is possible to leave a very thin layer of metal which transmits sufficient light such that the indicia are still visible.

The security feature provided by the security element 10 of the present invention has three elements; a high reflection layer defining first indicia, a first partial light scattering layer forming further indicia and a further light scattering layer. The high reflection layer is preferably provided by the metal layer 12 of the security element 10 described above and the additional layers will be described below.

Figure 2A:
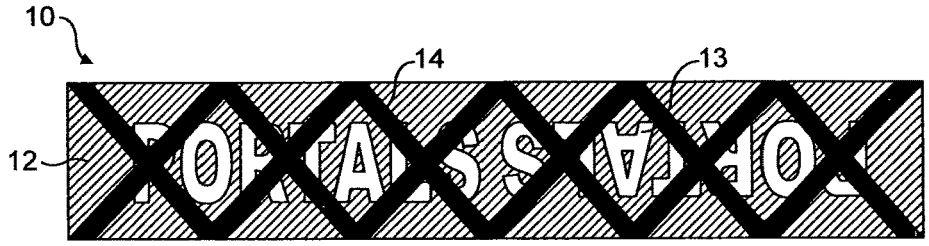

FIG. 2*a* is a plan view of a first embodiment of the present invention in which a security element 10 of the type described in EP-A-319157, and illustrated in FIG. 1, comprises a carrier layer 11 provided with a first partial light scattering layer 14 which is present in a localized area, for example as a simple geometric pattern. FIG. 2 has been drawn such that the partial light scattering layer 14 and its relationship with a demetallised design, formed by the metal-free areas 13, can be visualized.

The security element 10 can be partially or wholly embedded into a security substrate, such as paper used to manufacture secure documents, in one of the conventional formats known in the prior art. The wholly embedded security element 10 is covered on both sides by the base substrate and the partially embedded element 10 is visible only partly on the surface of the document in the form of a windowed security element. In the latter construction the security element appears to weave in and out of the substrate and is visible in windows in one or both surfaces of the document. One method for producing paper with so-called windowed threads can be found in EP-A-0059056. EP-A-0860298 and WO-A-03095188 describe different approaches for the embedding of wider partially exposed elements into a paper substrate. Wide elements, typically having a width of 2-6 mm, are particularly useful as the additional exposed element surface area allows for better use of optically variable devices, such as that used in the present invention. Security elements are now present in many of the world's currencies as well as vouchers, passports, travellers' cheques and other documents. In this embodiment the paper substrate covering the security element provides the required further scattering layer.

When the security substrate is viewed in transmission the security element 10 has substantially the same appearance to that of the prior art Cleartext® element, i.e. the negative text reading "PORTALS" is highly visible. However when a non-windowed side of the substrate is viewed in reflection the viewer is able to visualize the geometric pattern formed by the partial light scattering layer 14. The geometric pattern may be related to a print design to be provided on a substrate (in which the security element 10 is embedded) subsequently or could be unrelated. The present invention makes a benefit of the visualization of the light scattering material and additionally still retains all the benefits of the known Cleartext® element. The manner in which the partial light scattering layer 14 is applied does have to be carefully considered to ensure adequate visualization of the pattern but without the pattern detracting from any print or other information to be provided on the surface of the substrate subsequently.

Figure 2B:
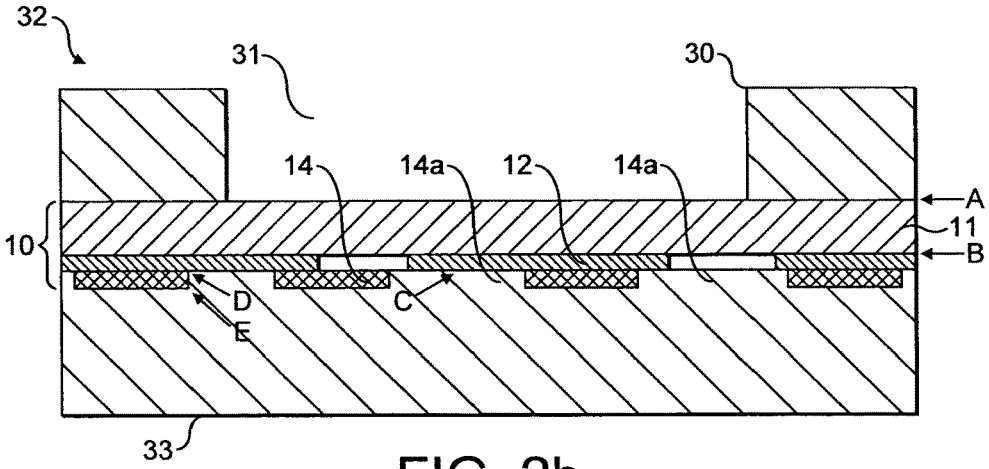

The visualisation of the partial light scattering layer 14 when the security element is provided with a further light scattering layer can be explained with reference to FIG. 2*b*. FIG. 2*b* shows a part of the security element 10 embedded into a paper substrate 30 such that one side of the security element 10 is exposed in windows 31 in the paper substrate 30 and the other side of the security element 10 is fully covered by the paper substrate 30. In this example the further light scattering layer is provided by the paper substrate 30 into which the security element 10 is partially embedded.

Light impinging on side B of the security element 10 passes through the paper substrate 30 which acts as the further light scattering layer where it is scattered to some extent. Where light is incident on the metal reflection layer 12 not covered by the light scattering layer (interface C), it is reflected back into the paper substrate 30 and then undergoes further scattering before exiting the paper substrate 30. In this case the light exiting the paper substrate 30 will be more diffuse than that incident on the paper substrate 30 due to the scattering effect of the paper substrate 30. Furthermore the reflected light will have lost some intensity when reflected at the metal interface C. This could equate, for example, to a 5% loss in intensity.

In contrast, where light is incident on the partial light scattering layer 14 it undergoes scattering when travelling both through the paper substrate 30 and the partial light scattering layer 14. The presence of the partial light scattering layer 14 will result in a proportion of the light reflected from the metal interface D being scattered back towards the metal interface D and undergoing multiple reflections at the metal interface D resulting in a loss of intensity (for example 5%) each time this occurs before finally exiting the substrate 30. The combination of intensity losses generated by the scattering of light from the paper substrate 30 and the partial light scattering layer 14 results in a significant reduction in the intensity of the reflected light from the regions of the security element 10 where the partial light scattering layer 14 is present compared to the regions 14*a* where the localised light scattering layer 14 is not present. This reduction in intensity results in the indicia formed by the partial light scattering layer 14 appearing relatively dark when viewed from the non-window side 33 of the security substrate 32 in FIG. 2*a*.

The further scattering layer may also be included in the security device 10 rather than making use of the scattering properties of the substrate 30 in which it is embedded. For example it is customary practice for security elements 10 having a width greater than approximately 2 mm to hide surfacing of the security element 10 from the embedded paper side by using a masking coat on the security element 10. A suitable material for such a masking coat would be Coates 3188XSN or Coates Heliovyl White S90 353. A typical coat weight is suggested to be in the region of 2GSM. Such a masking coat has similar scattering properties to paper such that light reflected from the security element 10 appears diffuse and has a paper like appearance.

Suitable light scattering layers 14 for use in the present invention include matt varnishes or lacquers and matt embossed structures. As highlighted above it is possible to provide light scattering layers 14 with additional machine detectable functionality, for example magnetic properties. Although it should be noted that, in this latter example, the magnetic materials used and their loading in an ink needs to be carefully controlled in order to achieve the necessary transparency and machine readability.

Any scattering layer could be used for the further scattering layer including the examples listed herein below for light scattering layer 14. However it is preferred if the further light scattering layer is sufficiently diffusing to provide a paper-like appearance.

It has been found that a surface area coverage for the light scattering layer 14 should be less than 70%, preferably less than 60%, and more preferably less than 50% of the overall thread surface area on one side. For non-magnetic light scattering layers 14 this is predominantly driven by aesthetic considerations. Whereas the surface area coverage set out above is suitable for meeting both the machine detection requirement and providing the visibility of the security element 10 in reflection when embedded in paper when using magnetic light scattering layers 14. However even lower surface area coverage can be achieved by providing a thicker magnetic light scattering layer 14 or by increasing the percentage magnetic material loading in the ink used as the magnetic light scattering layer 14. Use of too high a surface coverage of light scattering magnetic or non-magnetic material results in the security element 10 appearing as a substantially solid dark line which is not desirable.

Non Magnetic Light Scattering Layers

In these embodiments of the invention the scattering layer 14 takes the form of a matt varnish or lacquer which can be applied using one of the standard security printing processes. One example of a suitable matt varnish is a suspension of fine particles in an organic resin. The surface particles scatter the light as it passes through the varnish resulting in a matt appearance. The scattering process can be enhanced by the particles migrating to the surface of the varnish or lacquer when is applied to the carrier 11 or vacuum metallised layer 12. The surface particles scatter the light as it passes through the varnish resulting in a matt appearance. Suitable particles include silica based materials but it should be recognized that any particulate material could be used that causes a scattering of light but which does not detract from the transparency of the coating when it is applied to the security element 10. An example of a material suitable for forming a light scattering layer 14 is a screen printable matt varnish comprising 5% TS200 Silica Matting Agent from Degussa and 95% SX383 Solvent-Based Nitrocellulose Screen Varnish from Sericol.

In an alternative solution the fine particles can be replaced by organic waxes.

As a further alternative, the light scattering layer 14 can be generated by embossing a matt structure into the surface of the vacuum metallised layer 12. Such matt structures should typically comprises characters or patterns wherein the surface of the embossing is provided with a rough surface such that light impinging on the surface is reflected off in a diffuse non-specular manner. As an alternate the embossings themselves may be lines or dots of differing angles or sizes distributed so as to create a light scattering pattern.

Magnetic Light Scattering Layers

It has been found that certain new magnetic materials are particularly suitable for the present invention, although this does not preclude the use of more conventional heavily coloured conventional magnetic materials, such as iron oxides ($Fe_2O_3$, $Fe_3O_4$), barium or strontium ferrites etc.

The new materials have particular magnetic properties which allow them to be distinguished from other magnetic materials. In particular, these materials have a lower coercivity than conventional iron oxide materials which means that they can be reversed in polarity by weaker bias magnetic fields during the detection process; whilst they are still magnetically hard so that they retain the induced magnetism which can then be detected when the article is in a region no longer affected by the bias magnetic field. Typically, these materials can support magnetic data in the same manner as conventional magnetic tape.

Suitable new magnetic materials for the security element 10 preferably have a coercivity in the range 50-150 Oe, and more preferably in the range 70-100 Oe. The upper limit of 150 Oe could be increased with higher biasing fields. A number of examples of suitable materials include iron, nickel, cobalt and alloys of these. In this context the term "alloy" includes materials such as Nickel:Cobalt, Iron:Aluminium:Nickel:Cobalt and the like. Flake Nickel materials can be used; in addition Iron flake materials are suitable. Typical nickel flakes have lateral dimensions in the range 5-50 microns and a thickness less than 2 microns. Typical Iron flakes have lateral dimensions in the range 10-30 microns and a thickness less than 2 microns.

The preferred new materials include metallic iron, nickel and cobalt based materials (and alloys thereof) which have amongst the highest inherent magnetisations and so benefit from the requirement for least material in a product to ensure detectability. Iron is the best of the three with the highest magnetisation, but nickel has been shown to work well from other considerations. These materials are best used in their flake aspect to ensure that they are high remanence, hard magnetic materials that can support magnetic data if used in a magnetic tape format. This is because nickel and iron, for example, in flake form generally have high remanence. Flake and other shaped materials provide an anisotropy ($K_{shape}$) defined as:

$$K_{shape}=0.5N_dM_s^2/\mu_0$$

While $$H_c\alpha 2\cdot K_{total}/M_s$$

Leading to a coercivity $H_c$ which is proportional to $M_s$ and $N_d$ (See "Magnetism and Magnetic Materials", J P Jakubovics, Uni Press Cambridge, end Ed.)

Where:

$N_d$ is the shape factor $M_s$ is the saturation magnetism $\mu_0$ is the permeability of free space $H_c$ is the coercivity $K_{total}$ is the sum of all K components It should be understood, however, that it may not be essential to take account of this shape effect for a material to exhibit low coercivity and high remanence. For example, the crystalline anisotropy of materials can also lead to a high remanence, hard magnetic low coercivity characteristic even if the material has a spherical shape, for example cobalt treated oxides.

A suitable new magnetic ink composition for use with the present invention can be obtained from Luminescence Inc as 60681XM.

Conventional magnetic inks, with the common $Fe_2O_3$ or $Fe_3O_4$ pigments or similar, can, for example, be obtained from Luminescence Inc as RD1790.

The magnetic ink is applied to the security element 10 to form layer 14 during manufacture using any of the known printing and transfer techniques including for example, gravure, intaglio, lithography, screen, and flexography.

Figure 3:
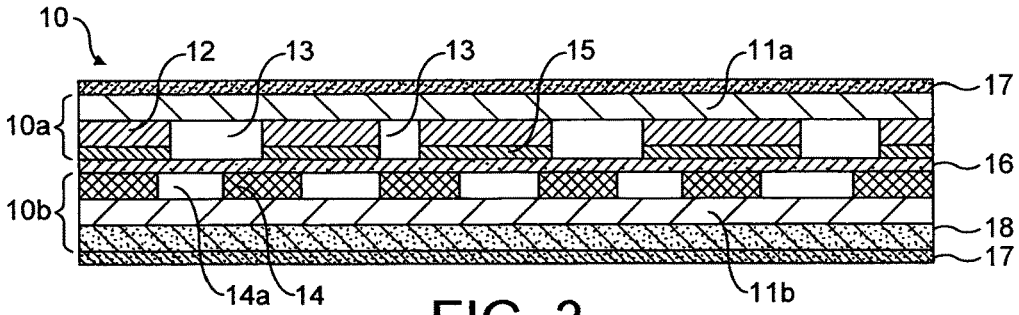
FIG. 3 is a cross sectional side elevation of another security element according to the present invention.

FIG. 3 shows a cross section through a security element 10 according to the present invention illustrate a construction for a simple magnetic, partially demetallised security element 10.

A first element 10*a* is first produced by a known a demetallisation technique as discussed above and comprises a plastic carrier substrate 11*a* of polyethylene (PET) and a metal layer 12 with metal free areas 13. FIG. 3 shows a resist layer 15 resulting from a resist and etch technique, but the resist layer 15 will not be present if one of the other techniques described above are used. A second element 10*b* is produced, also comprising an impermeable plastic carrier substrate 11*b*, such as polyethylene(PET). A partial light scattering layer 14 of a magnetic material is printed on this carrier substrate 11*b*, as described above. This magnetic partial light scattering layer 14 can also be printed on the reverse side of the first element 10*a*; in which case a primer layer may be required. In the example shown in FIG. 2, the magnetic partial light scattering layer 14 has been applied in a cross-hatch pattern. This pattern results in the security element 10 having a coverage of magnetic material of less than 50%. The first and second elements 10*a*, 10*b* are laminated together to form the security element 10 using a suitable laminating adhesive 16, an example of which is Novacote 10-2525/3346. One or more further water based adhesive (e.g. National Starch & Chemical Eclipse 033-4172) layers 17 is/are applied to the security element 10 to aid its adhesion when embedded in a security substrate 30.

Figure 4:
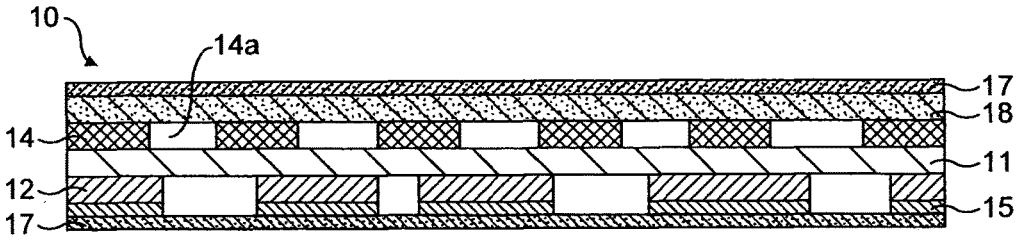
FIG. 4 is a cross sectional side elevation of an alternative embodiment of the invention.
Figure 5:
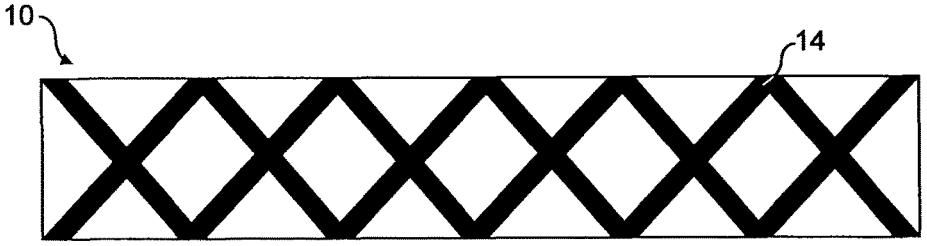
FIGS. 5 to 11 are plan views of further alternative embodiments of the present invention.

The embodiment of the security element 10 shown in FIG. 4 is similar in construction to that illustrated in FIG. 3, but without the second carrier substrate 10*b*. This is a less costly construction in terms of materials, but the security element 10 can be more vulnerable to environmental attack in service, unless the correct materials choices are specified to enhance durability. A particular advantage of this is that it makes the production route and construction consistent across the bulk of security element types and manufacturing routes.

An example of a particularly suitable PET material consistent with this single PET layer design requirement is Mylar 813 from Du Pont with the pretreated side available for the magnetic partial light scattering layer 14. This particular material, and others of a similar nature, allow fully durable externally printed magnetic coatings that resist the standard conventional security paper hazard testing and washing machine durability requirements.

In FIGS. 3 and 4, the security elements 10 have a white or coloured masking coat 18. The presence of the masking coat 18 provides a further scattering layer in the device structure resulting in the presence of the magnetic partial light scattering layer 14 being visualised as a dark image when viewed in reflection from the reverse side of the security element 10. If this security element 10 is subsequently embedded into a paper substrate 30 the visibility of the magnetic partial light scattering layer 14 will be further enhanced by the scattering properties of the paper. This masking layer 18 may also include fluorescent pigments.

Alternatively the masking layer 18 can be omitted from the structures as the magnetic partial light scattering layer 14 will still be visualized when embedded or partially embedded into the paper substrate 30 due to the scattering properties of the paper.

Figure 6:
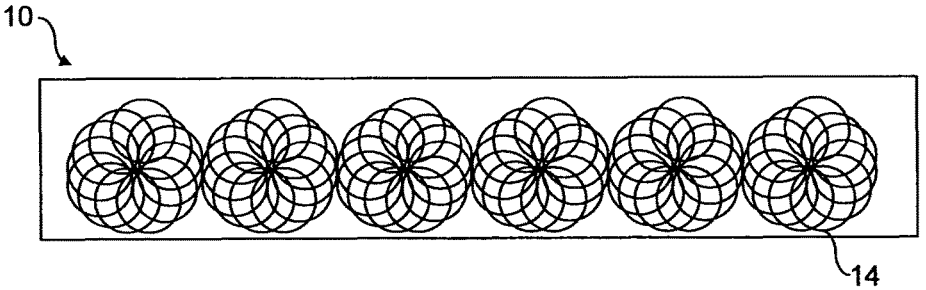

FIGS. 6 to 11 show various other examples of how the magnetic partial light scattering layer 14 can be applied to the security element 10. In FIG. 6 magnetic material has been applied as a complex geometric pattern. Such patterns may be designed such that they mirror or complement the guilloche patterns commonly used on a wide range of security documents.

Figure 7:
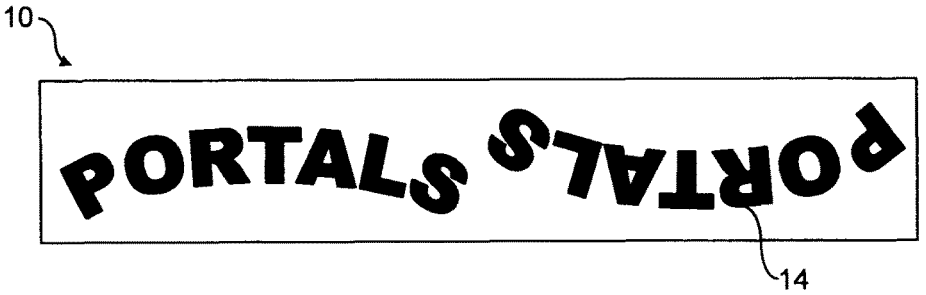

In FIG. 7 a magnetic ink has been printed as a repeating scripting reading "PORTALS". This embodiment provides a very strong combination feature with the negative script present in the metal layer 12. In reflection a viewer would see the positive text reading "PORTALS" and then in transmission they would see the same or an alternate negative script resulting from the demetallised layer 12/13.

Figure 8:
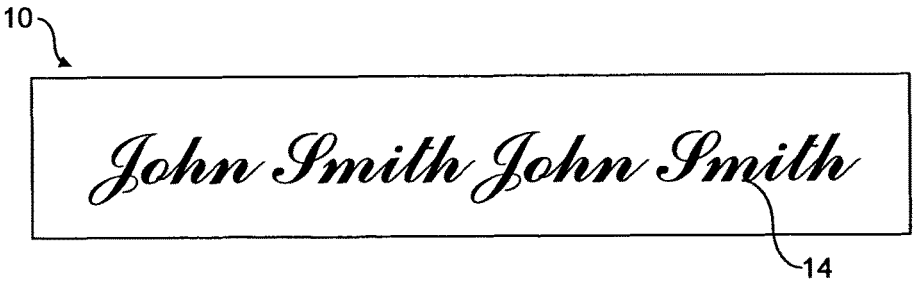

In FIG. 8 a magnetic material has been applied in the form of a signature. This signature may be a monarch, the Governor of a National Bank or, where there is a portrait present on the note, the signature of the individual portrayed. For banknotes (made from security substrates), the use of the Governor of the National Bank's signature is preferred as their signature is also usually printed on the banknote. The viewer can then compare the signature on the security element 10 with that on the printed surface of the banknote.

Figure 9:
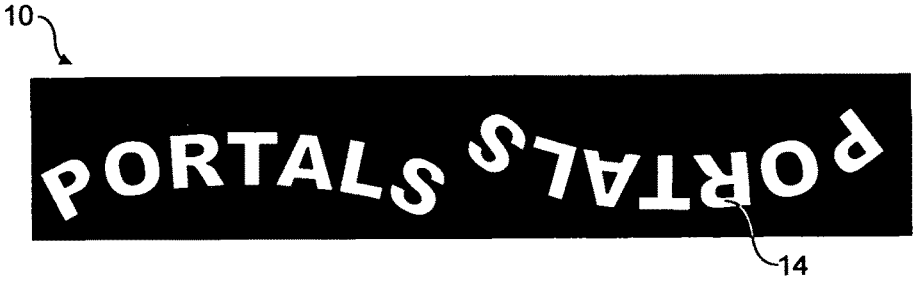

In FIG. 9 the magnetic material has been applied as a solid area with negative script present. In this example the viewer would visualize negative script in both reflection and transmission. As with previous examples the script can take any form or design and be the same or different to that provided by the demetallised pattern viewable in transmitted light.

Figure 10:
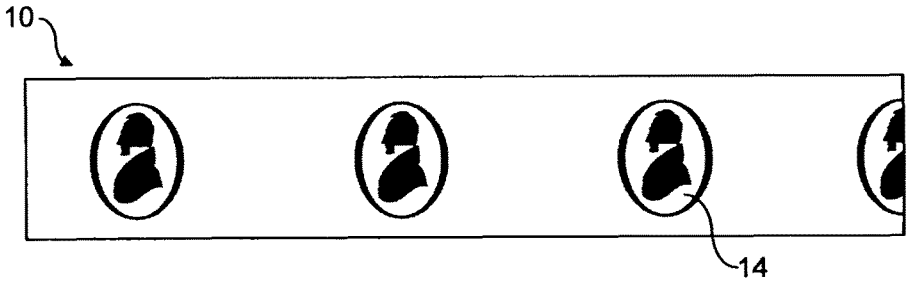

In FIG. 10 the magnetic material has been applied as a company logo. As an alternative to company logos, other identifying information could be used, such as national insignia, animals, flowers etc. This provides another strong link to the security document and another means to aid the authentication of the security device for the public.

Figure 11:
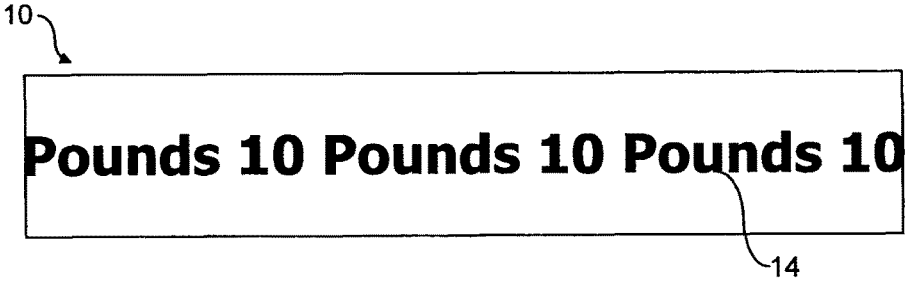

In FIG. 11 the magnetic material is printed so as to provide denomination information.

Figure 12:
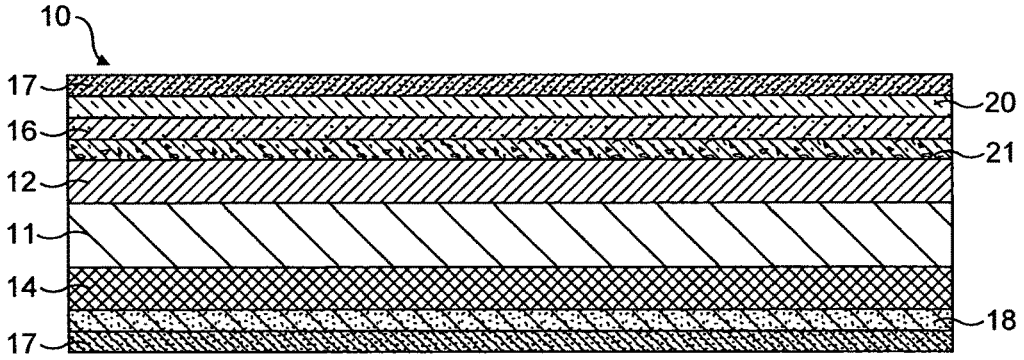
FIGS. 12 to 14 are cross-sectional elevations of further embodiments of the present invention.

FIG. 12 shows a detailed cross section through a further embodiment of a security element 10 according to the present invention. In this embodiment the security element 10 is provided with a liquid crystal layer 20. The security element 10 is further provided with a dark absorbing layer 21 that co-operates with the liquid crystal layer 20 to provide a strong coloursHifting effect with varying angle of viewing. In a preferred example a polymer liquid crystal is used, but an alternate example makes use of liquid crystal inks such as those supplied by Sicpa under the brand name Oasis™. The absorbing layer 21 is preferably a layer of dark or black resist in the etching of the metal layer 12.

Figure 13:
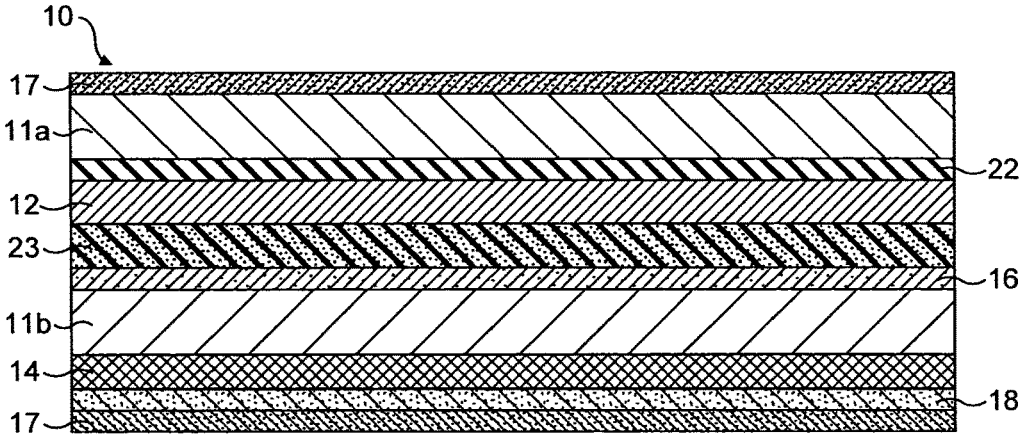

FIG. 13 shows a security element 10 provided with an embossing lacquer layer 22 which is embossed with a diffractive or holographic relief pattern.

Figure 14:
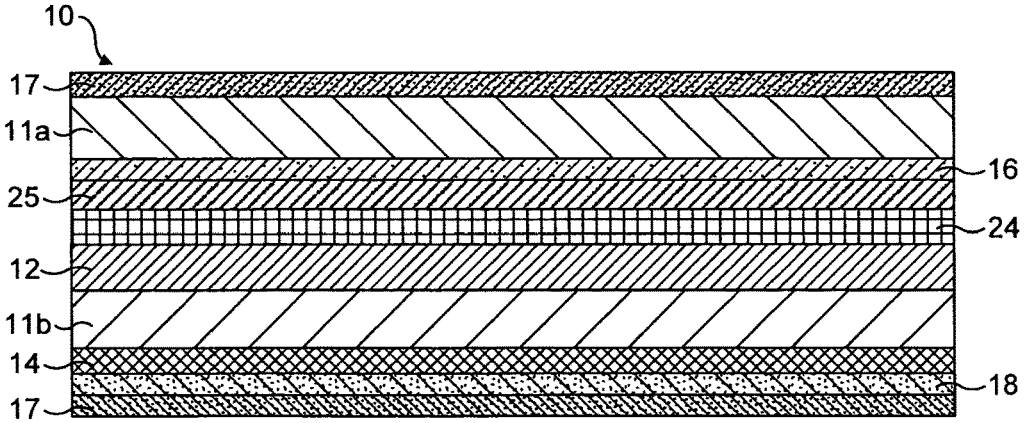

FIG. 14 shows an embodiment comprising a metal dielectric thin film coloursHifting security element 10 having a dielectric layer 24 and absorber layer 25.

As an alternative to printing the light scattering layer 14*a* embossed matt light scattering structures can also be used. Embossed matt light scattering structures cause incident light to be reflected non-specularly or diffusely.

The embossed light scattering structures can comprise lines and take any convenient form including straight (rectilinear) or curved such as full or partial arcs of a circle or sections of a sinusoidal wave. The lines may be continuous or discontinuous and, for example, formed of dashes, dots or other shapes. By other shapes we mean the dots or dashes could have a graphical form. The line widths are typically in the range 10-500 microns, preferably 50-300 microns. Preferably, the individual lines are barely visible to the naked eye, the main visual impression being given by an array of multiple lines. The lines can define any shape or form, for example square, triangle, hexagon, star, flower or indicia such as a letter or number.

The embossed line structures are preferably formed by applying an embossing plate to the security element under heat and pressure. Preferably the embossing process is an intaglio printing process and is carried out using an intaglio plate having recesses defining the line structures. Preferably the security element is blind embossed, i.e. the recesses are not filled with ink.

The height of the embossed areas should be at least 2 μm but preferably greater than 5 μm and more preferably greater than 10 μm.

In a further embodiment of the present invention the security device is incorporated into a polymeric banknote. Polymeric banknotes, such as those described in WO-A-8300659, are formed from a transparent substrate comprising at least one layer of an opacifying coating on both sides of the substrate. The opacifying coating is omitted in localised regions on both sides of the substrate to form a transparent region known as a window. In this embodiment of the present invention the security device is formed in a selected region on the transparent substrate of the polymeric banknote by applying a metallic layer and a first light scattering layer in the same manner as described previously. In this manner the transparent substrate of the polymeric banknote also acts as the light transmitting carrier substrate for the security device. The opacifying coating is then applied to the transparent polymeric substrate over the security device and functions as the further light scattering layer.

Polymeric banknotes are just one example of a secure document based on a polymeric substrate, the current invention is equally applicable to other types of polymeric secure documents.

The invention claimed is:

1. A security element comprising:

at least one light transmitting carrier substrate;

a first metal layer having substantially metal-free areas defining a first set of indicia having a defined shape which are visible in transmitted light; and a partial first light scattering layer forming a second set of indicia having a defined shape which are visible in reflected light, the defined shape of the indicia of the first set being different from the defined shape of the indicia of the second set, wherein the first light scattering layer overlaps the substantially metal free areas in the first metal layer.

2. A security element as claimed in claim 1 further comprising a second light scattering layer at least partially overlapping the first light scattering layer.

3. A security element as claimed in claim 1 in which the first light scattering layer and the metal layer are applied to opposing sides of the at least one carrier substrate.

4. A security element as claimed in claim 1 comprising a second carrier substrate to which the first light scattering layer is applied before the two carrier substrates are laminated together.

5. A security element as claimed in claim 1 in which the metal free areas are produced by a demetallisation process.

6. A security element as claimed in claim 1 in which a surface area coverage of the first light scattering layer is less than 70%.

7. A security element as claimed in claim 6 in which the surface area coverage of the first light scattering layer is less than 60%.

8. A security element as claimed in claim 7 in which the surface area coverage of the first light scattering layer is less than 50%.

9. A security element as claimed in claim 2 in which at least one of the light scattering layers is a layer of matt varnish.

10. A security element as claimed in claim 2 in which at least one of the light scattering layers is a lacquer layer.

11. A security element as claimed in claim 2 in which at least one of the light scattering layers is provided by a matt embossed structure.

12. A security element as claimed in claim 2 in which at least one of the light scattering layers is a magnetic layer.

13. A security element as claimed in claim 12 in which a material of the magnetic layer has a coercivity in the range of 50 to 150 Oe.

14. A security element as claimed in claim 12 in which the-material of the magnetic layer has a coercivity in the range of 70 to 100 Oe.

15. A security element as claimed in claim 12 in which the magnetic layer includes at least one material selected from the group consisting of iron, nickel, and cobalt.

16. A security element as claimed in claim 12 in which the magnetic layer comprises an iron flake material.

17. A security element as claimed in 12 in which the magnetic layer comprises a nickel flake material.

18. A security element as claimed in claim 12 in which the magnetic layer is a magnetic ink.

19. A security element as claimed in claim 1 in which the indicia provided by the first light scattering layer comprise a geometric pattern.

20. A security element as claimed in claim 1 in which the indicia provided by the first light scattering layer comprise alphanumeric information.

21. A security element as claimed in claim 1 in which the indicia provided by the first light scattering layer comprise a signature.

22. A security element as claimed in claim 1 in which the indicia provided by the first light scattering layer comprise pictorial indicia.

23. A security element as claimed in claim 1 in which the first light scattering layer is applied in a cross-hatch pattern having surface coverage of less than 50%.

24. A security element as claimed in claim 1 further comprising a liquid crystal layer and a dark absorbing layer which cooperates with the liquid crystal layer to provide a colourshift effect with varying angle of view.

25. A security element as claimed in claim 1 in which the security element is provided with an embossing lacquer layer which is embossed with a diffractive or holographic relief pattern.

26. A security element as claimed in claim 1 in which the security element comprises a metal dielectric thin film to provide a colourshifting effect.

27. A security substrate comprising a security element as claimed in claim 1 at least partially embedded therein.

28. A security substrate comprising a security element at least partially embedded therein, wherein said security element comprises:

least one light transmitting carrier substrate;

a first metal layer having substantially metal-free areas defining a first set of indicia having a defined shape which are visible in transmitted light;

a partial light scattering layer forming a second set of indicia having a defined shape which are visible in reflected light, the defined shape of the indicia of the first set being different from the defined shape of the indicia of the second set, wherein the partial light scattering layer overlaps the substantially metal free areas in the first metal layer, wherein the security substrate forms a further light scattering layer at least partially overlapping the first partial light scattering layer of the security element.

29. A security element comprising:

at least one light transmitting carrier substrate;

a first metal layer having substantially metal-free areas defining a first set of indicia which are visible in transmitted light; and a partial first light scattering layer forming a second set of indicia which are visible in reflected light, wherein the partial first light scattering layer is applied to the first metal layer and only partially overlaps the substantially metal-free areas in the first metal layer.

30. A security substrate comprising a security element at least partially embedded therein, wherein said security element comprises:

at least one light transmitting carrier substrate;

a first metal layer having substantially metal-free areas defining a first set of indicia which are visible in transmitted light; and a partial light scattering layer forming a second set of indicia which are visible in reflected light, wherein the partial light scattering layer is applied to the first metal layer and only partially overlaps the substantially metal-free areas in the first metal layer, and wherein the security substrate forms a further light scattering layer at least partially overlapping the first partial light scattering layer of the security element.

* * * * *